US005345987A

United States Patent [19]

Hagar

[11] Patent Number: 5,345,987

[45] Date of Patent: Sep. 13, 1994

[54] GOLF HEAD COVER

[76] Inventor: Gar Hagar, 2413 E. 42nd, Des Moines, Iowa 50317

[21] Appl. No.: 99,538

[22] Filed: Jul. 30, 1993

[51] Int. Cl.[5] ..... A63B 57/00

[52] U.S. Cl. ..... 150/160; 206/315.4

[58] Field of Search ..... 150/159, 160; 206/315.4, 315.6

[56] References Cited

U.S. PATENT DOCUMENTS

| | | | |
|---|---|---|---|
| 936,698 | 10/1909 | Breakspear | 206/315.6 |
| 2,014,589 | 9/1935 | Saad | 150/160 X |
| 2,035,529 | 3/1936 | Bucklin | 150/160 |
| 2,128,546 | 8/1938 | Venmore | 206/315.6 X |
| 2,471,169 | 5/1949 | Salzberg et al. | 206/315.4 |
| 2,595,987 | 5/1952 | Shears | 206/315.6 |
| 2,705,039 | 3/1955 | Halter | 150/160 |
| 2,747,636 | 5/1956 | Couture | 150/160 |
| 2,752,973 | 7/1956 | Stamp | 206/315.6 |
| 2,879,819 | 3/1959 | Turnbull | 150/160 X |
| 2,925,840 | 2/1960 | Hird | 150/160 X |
| 3,053,298 | 9/1962 | Stamp | 206/315.6 X |
| 3,664,399 | 5/1972 | Neff | 150/160 |
| 3,667,078 | 6/1972 | Destasio | 206/315.4 X |
| 3,967,667 | 7/1976 | Robinson | 206/315.4 X |
| 4,195,677 | 4/1980 | Hagg et al. | 150/160 |
| 4,368,768 | 1/1983 | Cunko, Jr. | 150/160 |
| 4,932,523 | 6/1990 | Yamazoe | 206/315.4 X |
| 5,000,238 | 3/1991 | Zeller | 150/160 |
| 5,005,624 | 4/1991 | Sung | 150/160 |
| 5,238,109 | 8/1993 | Smith | 206/315.6 X |
| 5,246,108 | 9/1993 | Nusbaum | 150/160 X |

FOREIGN PATENT DOCUMENTS

| | | | |
|---|---|---|---|
| 280427 | 11/1927 | United Kingdom | 206/315.5 |
| 383013 | 11/1932 | United Kingdom | 150/160 |
| 476107 | 11/1937 | United Kingdom | 206/315.3 |
| 510020 | 7/1939 | United Kingdom | 150/160 |

*Primary Examiner*—Sue A. Weaver

*Attorney, Agent, or Firm*—Brett J. Trout; Kent A. Herink; Brian J. Laurenzo

[57] ABSTRACT

An apparatus for attachment to a golf club bag for protecting the head of a golf club. A retaining means is attached to a golf bag and supports a head cover above the bag. A handle is provided on the head cover so that the handle may be grasped and moved upwardly and forwardly thereby allowing a club to be placed within the bag. The handle is then pulled downwardly and forwardly to position the head cover over the club. When a club is in use the apparatus maintains the head cover above the bag and in a position easily accessible for reinsertion of the club into the bag. The apparatus protects the golf clubs while preventing loss or damage to the head covers while the golf club is being used.

13 Claims, 3 Drawing Sheets

GOLF HEAD COVER

BACKGROUND OF THE INVENTION

The invention relates to a golf club cover device and, more specifically, to a golf club cover device which allows easy access to the golf club and retains the cover above the golf bag as the golf club is being used to prevent loss or damage to the cover.

Of the fourteen golf clubs allowed in regulation play, typically four or more of the clubs are "woods" which have a large head that is constructed of wood, graphite, steel, or some other material susceptible to scratching or marring. Because these woods often have a tendency to contact each other as the golf bag is moved and jostled from place to place, unprotected woods may become marred or defaced, particularly the face of the club. In mild cases the aesthetics of the club are damaged and the club merely becomes less appealing to the user. In more severe cases however, the clubs are irreparably damaged causing unpredictable flight of the golf ball and requiring replacement of the damaged club.

It is well known in the art to protect woods with covers which fit over the head of the club and are composed of a protective material which dissipates the impact of adjacent clubs contacting the head of the club. Such head covers are often sold matched sets of three or four to provide an aesthetic continuity between the covers. Unfortunately, as the head covers are typically handled individually, it is quite common for a golfer to forget to replace the cover on the golf club after a shot, or for one of the head covers to fall off of the head of a club as the golf bag is being transported. Moreover, known covers are often difficult to put back on a club after the shot is completed. When such a head cover is lost or misplaced a golfer must often replace the whole set of head covers as finding an exact replacement for a particular cover out of a matched set of covers is often difficult if not impossible.

Several devices have been created to connect head covers either to each other or to the golf bag to prevent misplacement of the head covers. Unfortunately, however, such devices are often unsightly and difficult to manipulate. Consequently, the simple connection devices such as strings or springs connecting the golf clubs to each other or to the bag are often discarded and the problem of misplaced head covers returns.

Accordingly, it is desirable to provide an apparatus for retaining golf club head covers on a golf bag as the golf club is being used, wherein the apparatus decreases the difficulty with which the head cover is placed upon or removed from the head of a golf club. Furthermore, it is desirable to provide an apparatus which eases the task of maintaining the head cover in an easily accessible position.

The difficulties in the prior art head covers are substantially eliminated by the present invention.

SUMMARY OF THE INVENTION

Accordingly, it is an object of the present invention to provide an apparatus for protecting the head of a golf club which retains a head cover above the golf bag as a particular club is being used.

It is another object of the present invention to provide an apparatus for protecting the head of a golf club which is easy to remove from a golf club and which is maintained in a position for easy replacement upon the golf club after the golf club has been used.

Another object of the present invention is to provide an apparatus for protecting a golf club which is easy to place on and remove from the golf club.

Yet another object of the present invention is to provide an apparatus for protecting the head and shaft of a golf club which is easily removed from the golf club to allow the golf club to be used and easily replaced upon the golf club after use.

Still another object of the present invention is to provide an apparatus which protects a golf club head cover from being crushed or sullied against a golf bag or on the ground as the golf club associated with the head cover is being used.

By the present invention, it is proposed to overcome the difficulties encountered heretofore. To this end, an apparatus is provided for attachment to a golf bag for protecting the head of a golf club. The apparatus is comprised of a golf club head cover being capable of covering at least a portion of the head of the golf club and of protecting the portion of the head of the golf club from physical contact with the heads of the other golf clubs in the golf bag. A means is provided for retaining the head cover above the golf bag in a protective position over the portion of the head of the golf club when the golf club head is placed within the golf bag. The retaining means is of a construction which allows the head cover to be moved into a golf club removal position above the golf bag which allows the head of the golf club to be removed from the head cover. After the golf club has been removed from the golf bag, the retaining means brings the head cover into a substantially upright golf club head receiving position above the golf bag to allow the golf club to be easily reinserted into the head cover after the golf club has been used and returned to the golf bag. The retaining means is attached to both the golf bag and the head cover.

In the preferred embodiment of the present invention the retaining means is a wire structure conformed substantially to the curve of the upper surface of the head of a golf club and supporting a golf club head cover. The wire structure is attached at either end portion to opposite sides at the top of a golf bag. A handle is attached to the golf club head cover, so that when it is desired to remove a golf club from the golf bag the handle is grasped and moved upwardly and forwardly thereby flexing the retaining means forwardly and moving the bottom of the head cover up and off of the particular golf club.

After the head cover has been removed from the golf club and the golf club has been removed from the golf bag, the handle on the head cover is released thereby allowing the retaining means to move substantially back into its former position. The head cover is thereby retained in a position which is accessible and which allows easy insertion of the golf club into the head cover after the golf club has been used and is reinserted into the golf bag.

DETAILED DESCRIPTION OF THE PREFERRED EMBODIMENT

Figure 1:
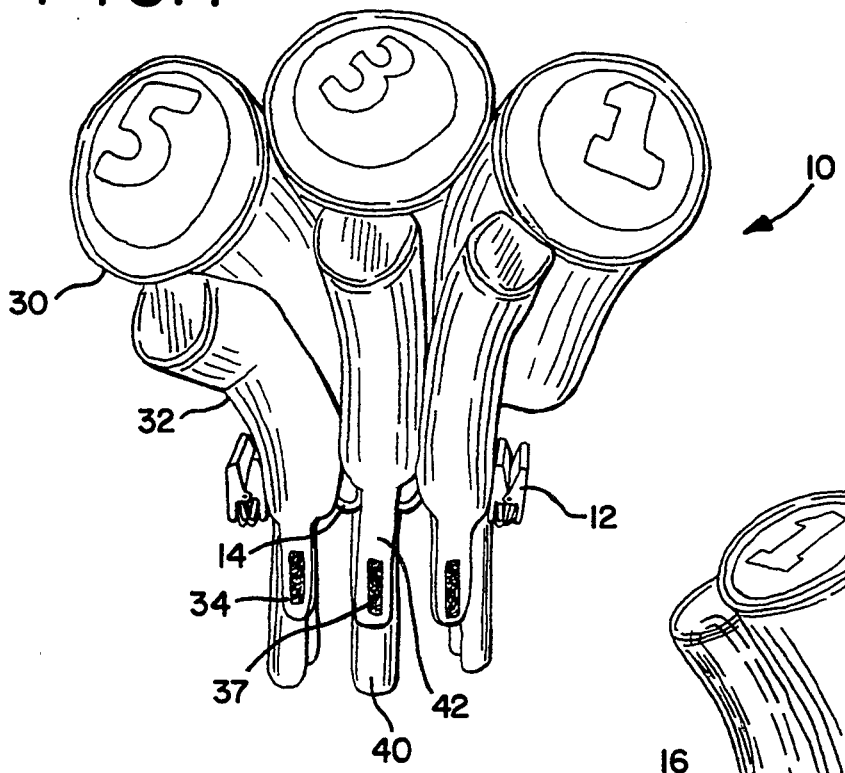
FIG. 1 is a rear view of the golf club head cover retaining apparatus of the present invention.
Figure 4:
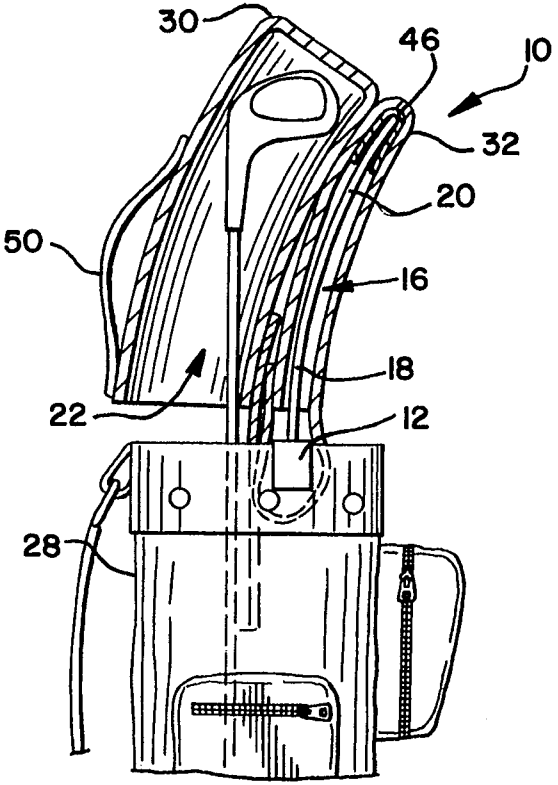
FIG. 4 is a side view of the apparatus shown in cross section showing the position of the arched support in relationship to the head of the golf club.
Figure 7:
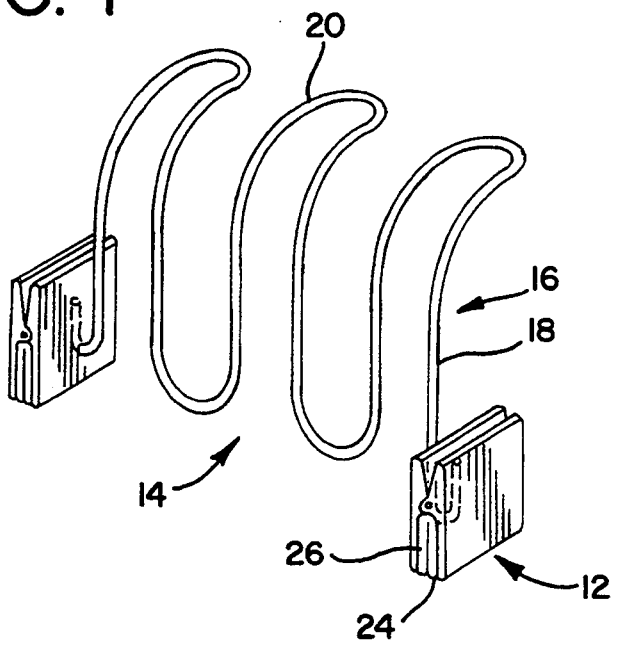
FIG. 7 is a perspective view of the wire framework secured to the golf bag retaining clips.

In the Figures, a golf club head cover retaining apparatus is shown generally at 10 (FIG. 1). The apparatus 10 consists of a pair of retaining clips 12 connected to a wire frame 14. As shown in FIG. 7 the wire frame 14 is bent to create a series of arched supports 16. The arched supports 16 have both a bottom section 18 and a top section 20. The top section 20 is bent in relation to the bottom section 18 to conform the shape of the arch support 16 to the curved shape of the upper surface of an inverted golf club 22 (FIGS. 4 and 7).

The retaining clips 12 are connected to the wire frame 14 by weldments or similar securement means to maintain the arch supports 16 upright as golf clubs 22 are inserted into and removed from the apparatus 10. The retaining clips 12 are preferably spring activated to allow the device to be releasably connected to opposing side portions of the top opening of a golf bag 28. Also preferably a small piece of rubber 24 is attached to interior 26 of the retaining clips to increase the stability and holding power of the retaining clips 12. The rubber 24 also prevents the retaining clips 12 from marring or otherwise defacing the golf bag 28 to which the apparatus 10 is attached.

Figure 5:
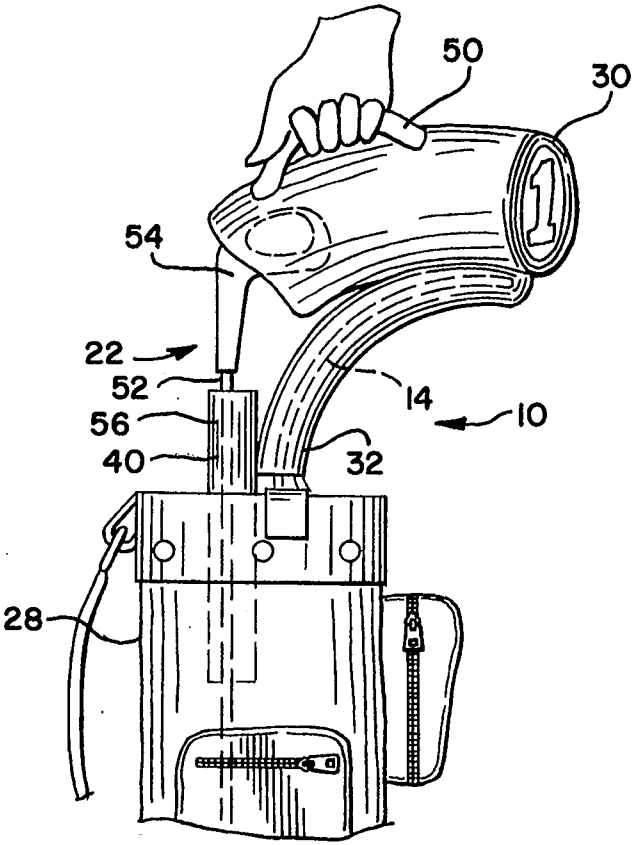
FIG. 5 is a side view of the golf club head cover retaining apparatus shown attached to a golf bag with one of the head covers being pulled by the handle off of one of the golf clubs.

Alternatively, the wire frame 14 may be connected by weldments or similar securement means directly to the golf bag 28 (FIG. 5). The advantage of this embodiment of the present invention is the lowered cost in eliminating the retaining clips 12 and the greater stability afforded by a direct connection of the frame 14 to the golf bag 28. One disadvantage of this embodiment is that the apparatus 10 cannot be easily moved from the golf bag 28 to another golf bag. The dimensions of the wire frame 14 may be formed to accommodate various size bags and various size clubs (FIG. 7).

Although the apparatus 10 is preferably constructed to fit either a standard seven inch diameter bag or a standard ten inch diameter bag, the apparatus 10 may be constructed to fit any size golf bag. A particular advantage of the wire frame 14 construction of the apparatus 10 is that the wire affords adaptability to the apparatus 10 by allowing the wire frame to be stretched to accommodate slightly oversized golf bags and squeezed together to accommodate slightly undersized bags.

Preferably, the curvatures of the arch supports 16 follow the curvature of the particular club 22 desired to be placed within the apparatus 10 (FIG. 4). To obtain an apparatus 10 which returns a head cover 30 more forcefully to a rest position after the golf club 22 has been removed from the head cover 30, less of a curve between the body section 18 and the top section 20 of the arch supports 16 may be utilized while a greater curvature in this area generally makes the head cover 30 easier to remove and replace upon the golf club 22.

Figure 2:
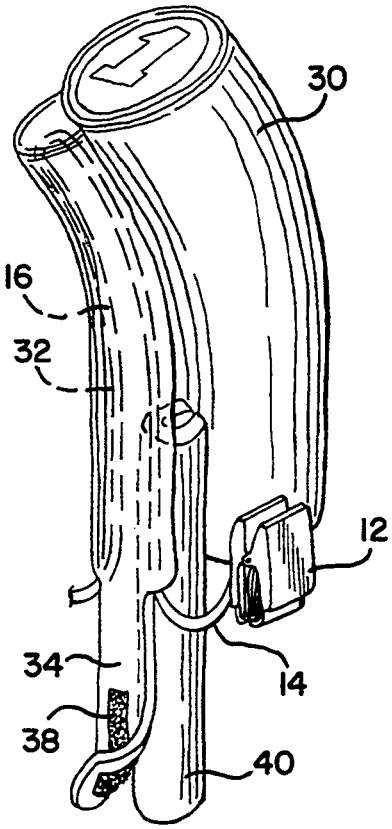
FIG. 2 is a a perspective view of a single head cover retaining apparatus showing the fluted shaft protector.

As shown in FIG. 2, sleeves 32 are placed over the arch supports 16 of the wire frame 14. Although the sleeves 32 are constructed of cotton in the preferred embodiment of the present invention, the sleeves 32 may be constructed of leather, vinyl, canvas or other suitable material or may be constructed of the same material as the head covers 30 to maintain aesthetic continuity of the apparatus 10. The sleeves 32 are connected by thread or similar securement means to the particular head cover 30 adjacent the particular arch support 16. In the preferred embodiment of the present invention, the sleeves 32 are constructed of two generally rectangular knitted cotton strips which are sewn to one another along their perimeters to form the sleeve 32.

Figure 3:
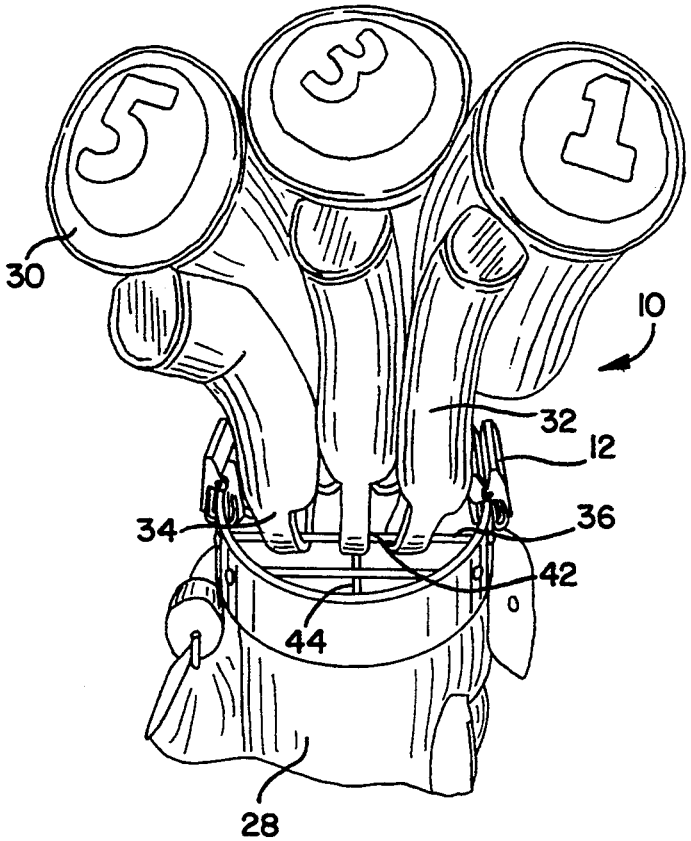
FIG. 3 is a rear view of the apparatus shown connected to a golf bag with the fabric strips connected around the horizontal bar of the golf bag.

Preferably one of the strips is longer than the other to create a retaining strap 34 depending from the sleeve 32 (FIG. 3). The retaining straps 34 are constructed so as to be placed around a horizontal support bar 36 of a golf bag 28 to add additional support to the apparatus 10. Attached to the retaining straps 34 are pieces of latch and hook material 37 such as Velcro® (FIG. 1). Opposing pieces of latch and hook material 38 are preferably placed on the opposite side of the retaining straps 34 to secure the latch and hook material 37 after the retaining straps 34 have been passed around the horizontal support bar 36 and curled back around toward the wire frame 14 (FIGS. 1 and 2). Alternatively, the latch and hook material 37 may be placed on the arch cover 32 or on a U-shaped shaft protector 40. Although Velcro® is used in the preferred embodiment of the present invention, buttons, snaps or similar securement devices may be used.

Preferably, the strap 42 depending from the center sleeve 32 is split to accommodate golf bags 28 having a vertical support bar 44 connected to the horizontal support bar 36 (FIG. 3). The ends of the center strap 42 are wrapped around the horizontal bar 36 just as the side retaining straps 34 and are connected to the interior sides of the center strap 42, thereby adding not only vertical stability to the apparatus 10 but also lateral stability by bracing the apparatus 10 against the vertical support bar 44.

In the preferred embodiment of the present invention the interior tops of the sleeves 32 are provided with a patch 46 of reinforcing material (FIG. 4). In the preferred embodiment of the present invention the patch 46 is constructed of canvas, but may, of course, be constructed of any strong supple material. Preferably, the patch 46 is square and secured to the interior of the top portion of the sleeves 32 by glue or similar securement means to prevent the top section 20 of the arch supports 16 from puncturing the sleeves 32.

Attached to the head cover 30 is a handle 50 consisting of a strip of sturdy, flexible material such as nylon (FIG. 5). In the preferred embodiment of the present invention, the handle is attached to the head cover at the top and bottom portions of the handle 50 to allow a golfer's hand to reach between the handle 50 and the head cover 30 to grasp and pull the head cover 30 up and over the golf club 22 so that the golf club 22 may be removed from the golf bag 28. The head cover 30 is preferably connected to the sleeve 32 at the top portion of the arch cover 32 so that as the head cover 30 is pulled from the golf club 22, the lower portion of the head cover 30 is free to move up and over the head of the golf club 22 (FIG. 5).

An additional feature of the present invention is the U-shaped shaft protector 40 which protects the shaft 52 of the golf club 22 while the head cover 30 protects the head 54 of the golf club 22 (FIG. 5). The U-shaft protector 40 consists of a fluted support which is covered with a layer of cotton or similar protective material 56 which may, of course, be matched to the material of the head covers 30 and/or sleeves 32. The protective material 56 is secured to the sleeve 32 by thread or similar connection preferable near the point where the top of the shaft protector 40 meets the bottom of the sleeve 32 (FIG. 5). Preferably, the fluted portion of the U-shaped shaft protector 40 is of a construction which allows the U-shaped shaft protector 40 to substantially surround the shaft 52 of the golf club 22 when the golf club is placed within the golf bag 28. The U-shaped shaft protector 40 is especially useful for shafts constructed of easily scratched materials such as graphite, fiberglass, and boron.

Figure 6:
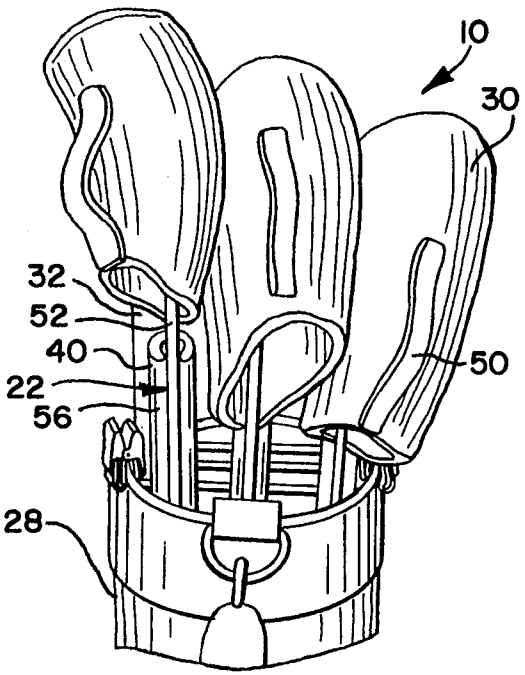
FIG. 6 is a front view of the golf club cover retaining apparatus of the present invention shown attached to a golf bag.

In use, the apparatus 10 is secured to the golf bag 28 by the retaining clips 12 and the retaining straps 34 and 42 (FIGS. 3 and 5). The handle 50 of the head cover 30 is grasped and pulled in a forward and upward arc and the golf club 22 is placed into the golf bag 28 with the shaft 52 of the golf club 22 being positioned within the recess of the U-shaped shaft protector 40. The head cover 30 is then drawn in a rearward and downward arc over the head 54 of the golf club 22 and slid down the shaft 52 of the golf club 22 until the head 54 of the golf club 22 contacts the top of the head cover 30. After all of the golf clubs 22 have been inserted into the bag 28 and covered with their respective head covers 30, the bag 28 and clubs 22 are ready for transport or storage (FIG. 6). When it is desired to remove a club 22 from the bag 28, the handle 50 is grasped and pulled upward to move the bottom of the head cover 30 along the shaft 52 of the golf club 22 and over the head 54 of the golf club 22 (FIG. 5). As soon as the head cover 30 is removed from the head 54 of the golf club 22, the golf club 22 is removed from the golf bag 28 and the handle 50 is released to allow the arch support 16 to return the head cover 30 into its former position.

After the golf club 22 has been used and it is desired to return the golf club 22 to the golf bag 28, the handle 50 is again grasped and pulled forward and upward (FIG. 5). The golf club 22 is then inserted into the golf bag 28 so that the shaft 52 of the golf club 22 is placed within the recess of the U-shaped shaft protector 40 and the bottom of the head cover 30 is pulled over the head 54 of the golf club 22. After the head cover 30 has been secured over the head 54 of the golf club 22, the golf club 22 and golf bag 28 are again ready for storage or transport.

Figure 8:
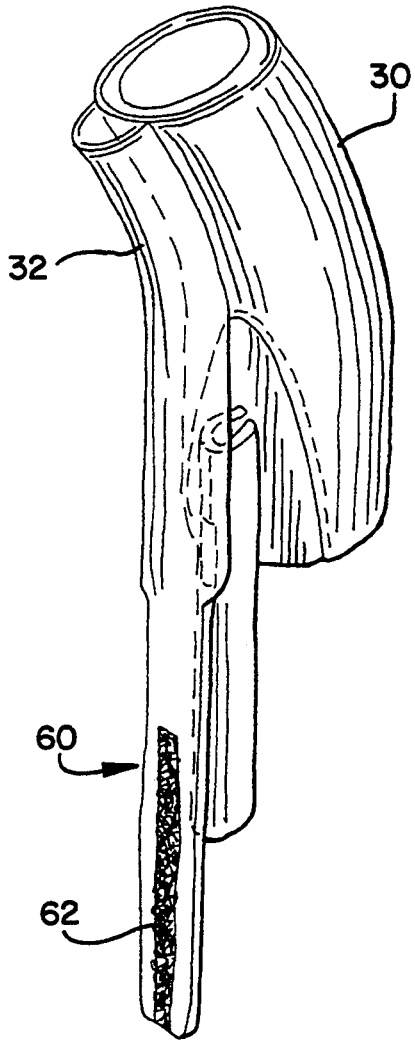
FIG. 8 is a perspective view of an alternative embodiment of the present invention showing an elongated fabric strip having an attachment medium placed along the entire length of the strip to allow the apparatus to accommodate various size clubs.

FIG. 8 shows an alternative embodiment of the present invention wherein the retaining strap 60 is elongated and a large strip of latch and hook material 62 is attached along the length of the retaining strap 60 to allow the apparatus to accommodate longer clubs or bags with deeper cross bars.

The foregoing description and drawings merely explain and illustrate the invention and the invention is not limited thereto, except insofar as the claims are so limited, as those skilled in the art who have the disclosure before them will be able to make modifications and variations therein without departing from the scope of the invention. For example, the length of the wire in the wire frame 14 may be elongated or shortened or the spacing between the arch supports 16 may be lengthened or shortened to accommodate various sized bags. It is additionally contemplated that the apparatus 10 may be fitted with any number of arch supports 16 to accommodate any number of clubs. It is further contemplated that smaller versions of the apparatus 10 may be constructed to accommodate irons or a putter.

I claim:

1. An apparatus attached to a golf bag for protecting a head of a golf club comprising:

(a) a golf club cover having sides, a top, and an opening provided below said top; and (b) means operably attached between the golf bag and said golf club head cover, for retaining said head cover in a substantially vertical protective position over the head of the golf club when said head cover is covering at least a portion of the head of the golf club, and for supporting said head cover above the golf bag as said head cover is moved from said substantially vertical protective position over the head of the golf club, to a substantially horizontal removal position off the head of the golf club, and for supporting said head cover above the golf bag as said head cover is moved from said substantially horizontal removal position off the head of the golf club to said substantially vertical protective position over the head of the golf club.

2. The apparatus of claim 1, further comprising a substantially fluted shaft protector, secured to said retaining and supporting means and depending into the golf bag.

3. The apparatus of claim 1 further comprising a handle attached to said head cover thereby allowing said head cover to be more easily removed from the golf club.

4. The apparatus of claim 1 wherein said retaining and supporting means includes a flexible wire frame having at least one arched support.

5. The apparatus of claim 4 wherein said flexible wire frame is secured to the golf bag by a clip.

6. The apparatus of claim 5 further comprising a means for protecting the golf bag from damage due to attachment of said clip to the golf bag, said golf bag protecting means being secured to said clip.

7. The apparatus of claim 4 wherein said retaining and supporting means further includes a sleeve secured over said arched support and attached to said head cover.

8. The apparatus of claim 7 further comprising a flexible mounting strap member depending from said sleeve.

9. The apparatus of claim 8 wherein said flexible mounting strap member is wrapped around a support bar of the golf bag and secured to itself.

10. The apparatus of claim 1 further comprising means for substantially protecting a shaft of the golf club from physical contact with the golf bag and with adjacent clubs, said shaft protecting means being attached to said retaining means.

11. The apparatus of claim 10 further comprising a flexible mounting strap member having a securement loop and an attachment end, wherein a support bar of the golf bag is provided through the securement loop and wherein the attachments end is secured to said shaft protecting means.

12. The apparatus of claim 11 wherein said attachment end of said flexible mounting strap member is also secured to said arched support to add stability to said flexible wire frame.

13. A golf club head cover retaining apparatus for protecting a golf club having a head and a shaft wherein the apparatus maintains the top of a golf club head cover above and out of contact with a golf bag having a top and a bottom, after the head of the golf club has been removed from the head cover and the golf club has been removed from the bag, comprising:

(a) a flexible wire frame releasably connected to the golf bag, said flexible wire frame having a substantially arched member with a bottom portion and a top portion, said bottom portion extending above the top of the golf bag substantially normal to the plane of the ground when the golf bag is in an upright position, said top portion of said substantially arched member being curved away from said normal position to accommodate substantially the curvature of the head of the golf club;

(b) a fabric covering surrounding at least a portion of said substantially arched member of said flexible wire frame;

(c) a strip which is connected to said fabric covering and depends below said substantially arched member to allow said flexible wire frame to be secured to the golf bag by said strip passing around a cross bar which substantially spans the top of the golf bag, said strip then being attached to a portion of said fabric covering, to thereby secure the head cover retaining apparatus to the golf bag;

(d) a golf club head cover attached to said flexible wire frame and configured to cover and protect the head of the golf club from physical contact with heads of adjacent clubs;

(e) a head cover handle connected to said head cover, said handle allowing said head cover to be more easily removed from the golf club;

(f) a fluted shaft protector with a substantially U-shaped cross-section, said fluted shaft protector having a lower portion which depends into the golf bag and below the top of the golf bag, and said fluted shaft protector also having an upper portion;

(g) means for operably attaching said flexible wire frame to the golf bag; and (h) means for operably connecting said upper portion of said fluted shaft protector to said flexible wire frame.

* * * * *